US006802785B2

(12) United States Patent
Jordan et al.

(10) Patent No.: US 6,802,785 B2
(45) Date of Patent: Oct. 12, 2004

(54) GOLF BALLS INCLUDING A LAYER WITH REINFORCED FIBERS AND METHODS FOR FORMING SUCH GOLF BALLS

(75) Inventors: Michael D. Jordan, East Greenwich, RI (US); Christopher Cavallaro, Lakeville, MA (US)

(73) Assignee: Acushnet Company, Fairhaven, MA (US)

( * ) Notice: Subject to any disclaimer, the term of this patent is extended or adjusted under 35 U.S.C. 154(b) by 14 days.

(21) Appl. No.: 10/216,459

(22) Filed: Aug. 9, 2002

(65) Prior Publication Data

US 2004/0029651 A1 Feb. 12, 2004

(51) Int. Cl.[7] ..... A63B 37/12
(52) U.S. Cl. ..... 473/378
(58) Field of Search ..... 473/373, 374, 473/376, 378

(56) References Cited

U.S. PATENT DOCUMENTS 5,688,191 A * 11/1997 Cavallaro et al. ..... 473/373
5,783,293 A 7/1998 Lammi ..... 428/212
6,012,991 A * 1/2000 Kim et al. ..... 473/374
6,142,887 A 11/2000 Sullivan et al. ..... 473/374
6,183,382 B1 2/2001 Kim et al. ..... 473/374

OTHER PUBLICATIONS

"Stiff Competition, Long–Fiber–Reinforced Thermoplastics Are Gathering Strength in Key Industries," C&E News, vol. 80, No. 4 (Jan. 28, 2002).

"The Pultrusion Process," available at www.olemiss.edu/depts/compmat/pultrusion.html ( Published date unknown).

* cited by examiner

*Primary Examiner*—Mark S. Graham
*Assistant Examiner*—Raeann Gordon
(74) *Attorney, Agent, or Firm*—William B. Lacy

(57) ABSTRACT

The present invention is directed to a golf ball with a core and a polymeric layer reinforced with relatively long fibers. Such layer can be the cover, a portion of the cover, an intermediate layer, a portion of the intermediate layer, or any layer in the golf ball. Preferably, this layer comprises relatively long fibers embedded in a thermoplastic matrix to increase the flexural modulus and the impact resistance of the thermoplastic. The fibers may be arranged in random or non-random pattern in the layer.

25 Claims, 6 Drawing Sheets

GOLF BALLS INCLUDING A LAYER WITH REINFORCED FIBERS AND METHODS FOR FORMING SUCH GOLF BALLS

TECHNICAL FIELD OF INVENTION

The present invention generally relates to a golf ball including a layer containing relatively long reinforced fibers and methods for forming such golf ball, where the fibers may be arranged randomly or non-randomly. The present invention is also directed to a golf ball including a layer reinforced with relatively long fibers to increase its stiffness and its impact resistance.

BACKGROUND OF THE INVENTION

Conventional golf balls have primarily two functional components: the core and the cover. The primary purpose of the core is to be the "spring" of the ball or the principal source of resiliency. The core may be solid or wound. The primary purpose of the cover is to protect the core. Multi-layer solid balls include multi-layer core constructions or multi-layer cover constructions, and combinations thereof. In a golf ball with a multi-layer core, the principal source of resiliency is the multi-layer core. In a golf ball with a multi-layer cover, the principal source of resiliency is the single-layer core.

Two-layer solid balls are made with a single-solid core, typically a cross-link polybutadiene or other rubber, encased by a hard cover material. Increasing the cross-link density of the core material can increase the resiliency of the core. As the resiliency increases, however, the compression may also increase making the ball stiffer, thereby reducing driver spin rates. In an effort to make golf balls with improved performance characteristics, manufacturers have used thermoplastics in various layers in multi-layer golf balls. Some thermoplastic materials have a low flexural modulus, such that layers formed therefrom produce golf balls with driver spin rates at higher than desirable levels. Such high spin rates, although allowing a more skilled player to maximize control of the golf ball, can also cause golf balls to have severely parabolic trajectories and do not achieve sufficient distance. Thus, manufacturers often try to strike a balance between spin rate and distance. By adding fillers in thermoplastic layers, the flexural modulus or stiffness of such layers increases, so that the golf balls produced have lower spin rates and can achieve greater distances. As flexural modulus increases in these golf balls, however, impact resistance decreases. Consequently, such golf balls may lack sufficient impact resistance to withstand repeated club impacts. This lack of impact resistance has made filled thermoplastics impractical for use in golf balls.

Therefore, a need exists for a golf ball with a filled thermoplastic layer that exhibits an acceptably high flexural modulus (for lower driver spin) in combination with sufficiently high impact resistance.

SUMMARY OF THE INVENTION

Accordingly, the present invention is directed to a golf ball with a core and a polymeric layer reinforced with relatively long fibers.

The present invention is also directed to a golf ball with a layer comprising relatively long fibers embedded in a thermoplastic matrix to increase the flexural modulus and the impact resistance of the thermoplastic matrix. This layer can be the cover, a portion of the cover, an intermediate layer, a portion of the intermediate layer, or any layer in the golf ball.

The present invention is also directed to a golf ball with a fiber-reinforced layer where the fibers may be arranged in random or non-random pattern in the layer.

The present invention is directed to a golf ball comprising a core and at least one layer encasing the core, wherein at least a portion of the encasing layer is made from a pultruded polymer and wherein said protruded polymer comprises a plurality of discrete fibers orientated in a predetermined pattern and embedded in a polymeric matrix. In one embodiment, said portion of the encasing layer is made by compression molding shells formed by injection molding the pultruded polymer, and the orientation of the fibers in said portion of the encasing layer is different than the predetermined pattern. The encasing layer may be a sandwich layer comprising an inner layer, an outer layer and an intermediate layer, wherein the intermediate layer is made from a pultruded polymer. The fibers are at least about 1 mm long, preferably about 1 mm to about 5 mm long, more preferably about 1 mm to about 3 mm long, and most preferably about 1.5 mm long. The predetermined pattern of the fibers in the pultruded polymer comprises the fibers arranged substantially parallel to each other.

In another embodiment, the reinforced portion of the encasing layer is made by compression molding shells cut from a sheet of the pultruded polymer, wherein the orientation of the fibers in said portion of the encasing layer is substantially the same as the predetermined pattern of the fibers in the pultruded polymer. The fibers are at least about 1 mm long, and can be as long as about one-half of the circumference of the encasing layer.

The encasing layer can be a cover layer or an intermediate layer, and the fibers can be aramid fibers, glass fibers, carbon fibers, metallic fibers, ceramic fibers, cotton fibers, flax, jute, hemp, silk, among others. The polymeric matrix of the pultruded polymer is preferably a thermoplastic polymer. In accordance to one aspect of the invention, suitable thermoplastic polymer has a flexural modulus between about 500 psi to about 30,000 psi, and in accordance to another aspect of the invention suitable thermoplastic polymer has a flexural modulus greater than about 70,000 psi or greater than about 80,000 psi.

The present invention is also directed to a golf ball comprising a core and at least one layer encasing the core, wherein the encasing layer is reinforced by a plurality of discrete fibers arranged in a predetermined pattern embedded in a polymeric matrix. The predetermined pattern comprises discrete fibers arranged substantially parallel to each other. The encasing layer is preferably made from a pultruded polymer. The fibers are at least about 1 mm long and can be as long as one-half of the circumference of the encasing layer.

DETAILED DESCRIPTION OF THE PREFERRED EMBODIMENTS

Figure 1:
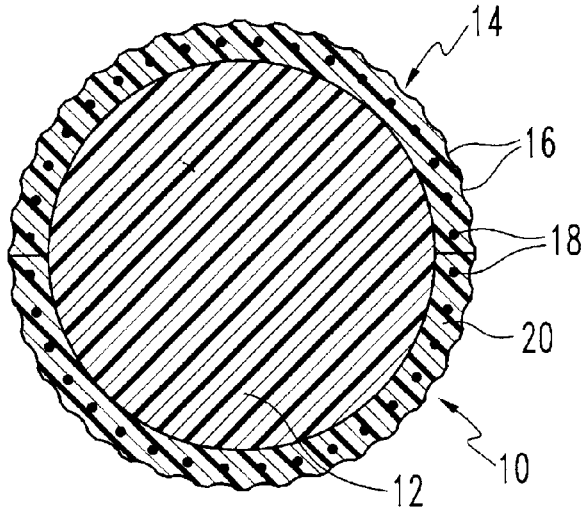
FIG. 1 is a cross-sectional view of a first embodiment of a golf ball of the present invention.

Referring to FIG. 1, golf ball 10 includes a core 12 surrounded by at least one cover layer 14 made from a fiber reinforced polymer. Preferably, layer 14 is formed by a pultrusion and compression molding method, or a pultrusion, injection molding and compression molding method, as discussed below.

Core 12 may have any dimension or composition, such as thermoset rubber, thermoplastic, metal, or any material known to one skilled in the art of golf ball manufacture. Core 12 can be a single layer solid core, a two-layer core with a molded or wound outer core layer and a solid or fluid-filled center, or a multi-layer core, as known by those of ordinary skill in the art. Preferably, the core 12 comprises a resilient polymer such as polybutadiene, natural rubber, polyisoprene, styrene-butadiene, or ethylene-propylene-diene rubber or highly neutralized polymers. This base material may be combined with other components as known by one of ordinary skill in the art. The base composition can be mixed and formed using conventional techniques to produce the core 12.

Cover layer 14 is preferably formed with a plurality of dimples 16 or surface protrusions defined on the outer surface thereof. The polymer forming the cover layer 14 includes a plurality of relatively long fibers or filaments 18 completely embedded in a polymeric matrix or binder material 20. Preferably, each fiber is relatively long or has a length greater than about 1 mm, and can be as long as about 25 mm or longer. The fiber length may be altered by the method(s) used to form layer 14, as discussed below. Fiber length is an important aspect of the present invention. As discussed above, when the fiber length is relatively short, e.g., in the range of about 0.3 mm, the addition of such fibers to thermoplastic polymers decreases the impact resistance of the polymers. When fiber length is in the preferred long range, both the flexural modulus and the impact resistance increase.

Figure 2:
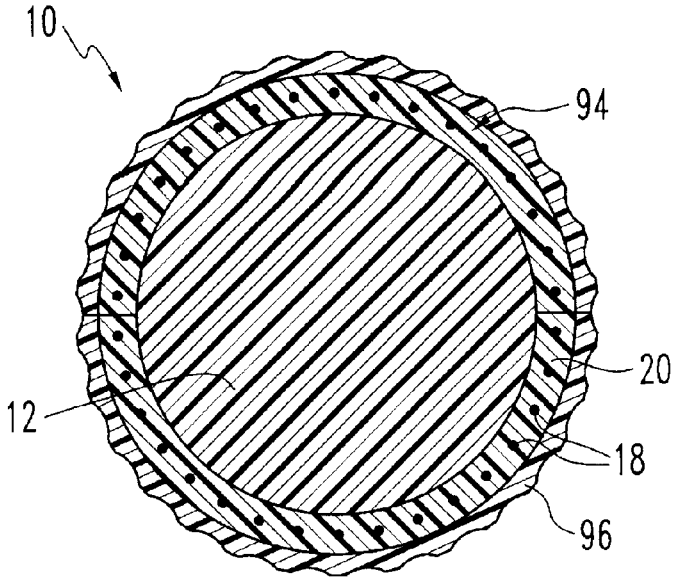
FIGS. 2–4 are cross-sectional views of additional embodiments of golf balls of the present invention, respectively.
Figure 3:
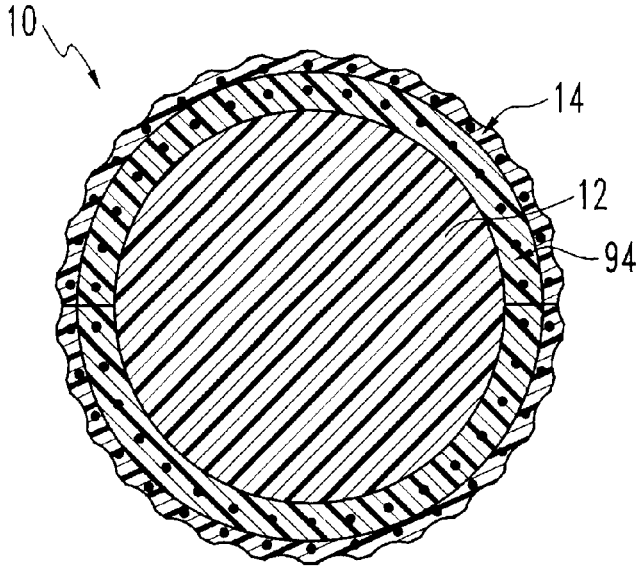
Figure 4:
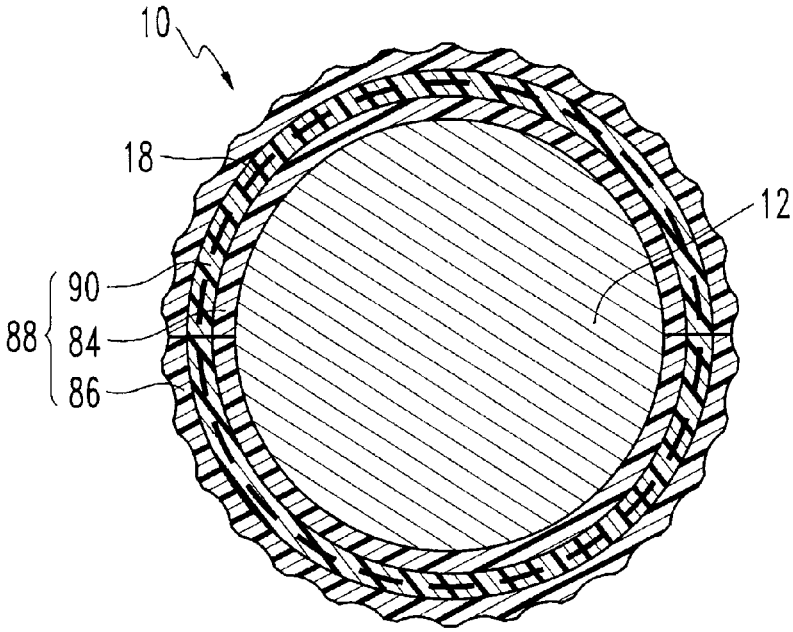

As illustrated in FIG. 1, the fiber-reinforced polymer is utilized in layer 14, which is a single layer cover. The fiber-reinforced polymer may be utilized in any layer or layers in the golf ball, as illustrated in FIGS. 2–4 and discussed further below.

Suitable fibers 18 include aramid fibers, such as KEVLAR® fibers, glass fibers, such as E fibers, S-GLASS® and Cem-Fil filament fibers, carbon materials, such as graphite fibers and carbon fibers, metallic fibers, such as copper and steel, ceramic fibers, cotton fibers, flax, jute, hemp, silk, among others. Combinations of fibers of different materials can also be combined in a single layer cover. KEVLAR® fibers are available from E. I. Du Pont de Nemours. S-GLASS® fibers are available from Corning Corporation. Exemplary commercially available suitable carbon fibers include Thornel® available from Cytec.

Figure 5:
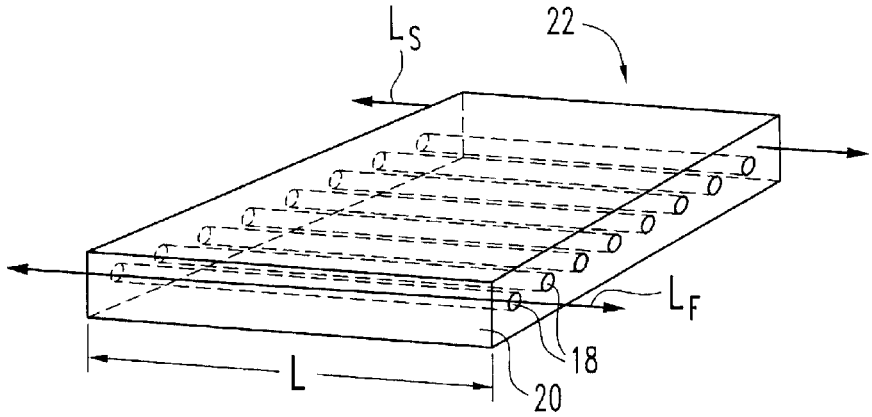
FIG. 5 is an enlarged perspective view of a sheet including non-randomly oriented fibers in a polymeric matrix for use in making golf balls in accordance to the present invention.

In accordance to one aspect of the present invention, cover layer 14 is formed from a pultruted polymeric material, such as sheet 22 shown in FIG. 5. Each sheet 22 is relatively flat or alternatively has a substantially rectangular cross-sectional shape, and includes a plurality of spaced apart fibers 18 embedded in matrix material 20. Each fiber 18 has a fiber longitudinal axis $L_F$, and each thin sheet 600 has a sheet longitudinal axis $L_S$. Preferably, sheet 22 has a thickness less than about 0.030 inch. The fibers 18 are non-randomly oriented or oriented in a predetermined direction with respect to one another in the matrix 20, such that the longitudinal axis $L_F$ of the fibers 18 are substantially parallel to one another and substantially parallel with the sheet longitudinal axis $L_S$.

Figure 6:
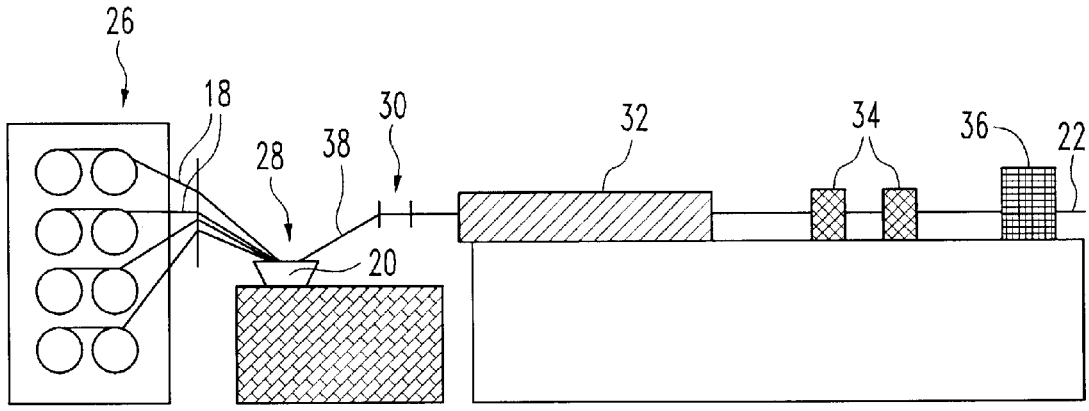
FIG. 6 is a schematic view of a conventional pultrusion apparatus used to make sheets as shown in FIG. 5 and pellets as shown in FIG. 8.

As illustrated in FIG. 6, sheet 22 may be formed by a conventional pultrusion apparatus 24. The pultrusion apparatus 24 generally includes a source 26 of fibers 18, a bath 28 of the matrix material 20, preform plates 30, a heated die 32, pullers 34, and a cutter 36. Long lengths of fibers 18 are kept on spools at the source 26, and fibers 18 can be a single continuous fiber or a bundle of continuous fibers. Bath 28 of the matrix material 20 is located downstream of fiber source 26. When the fibers 18 are pulled through the bath 28 by the pullers 34, matrix material 20 coats the fibers 18 and may penetrate fibers 18 to form coated fibers 38. Coated fibers 38 have matrix material 20 is disposed within depressions in the outer surface of the fibers or between fibers in a multi-fiber bundle.

Next, the coated fibers 38 pass through the preform plates 30, which shape the coated fibers 38 by removing excess matrix material 20, among other things. Then, the coated fibers 38 pass through the heated die 32, which partially cures the matrix material 20 and forms coated fibers 38 into the shape of the die, in this case a thin rectangular sheet. The partially cured sheet 22 exits the heated die 32. The term "pultrusion" means that fibers 18 are pulled rather than pushed as in the case of extrusion. Subsequently, the pullers 34 move the partially cured sheet to cutter 36 for cutting into discrete sheets 22 (as shown in FIG. 5) having a predetermined length L.

Figure 7:
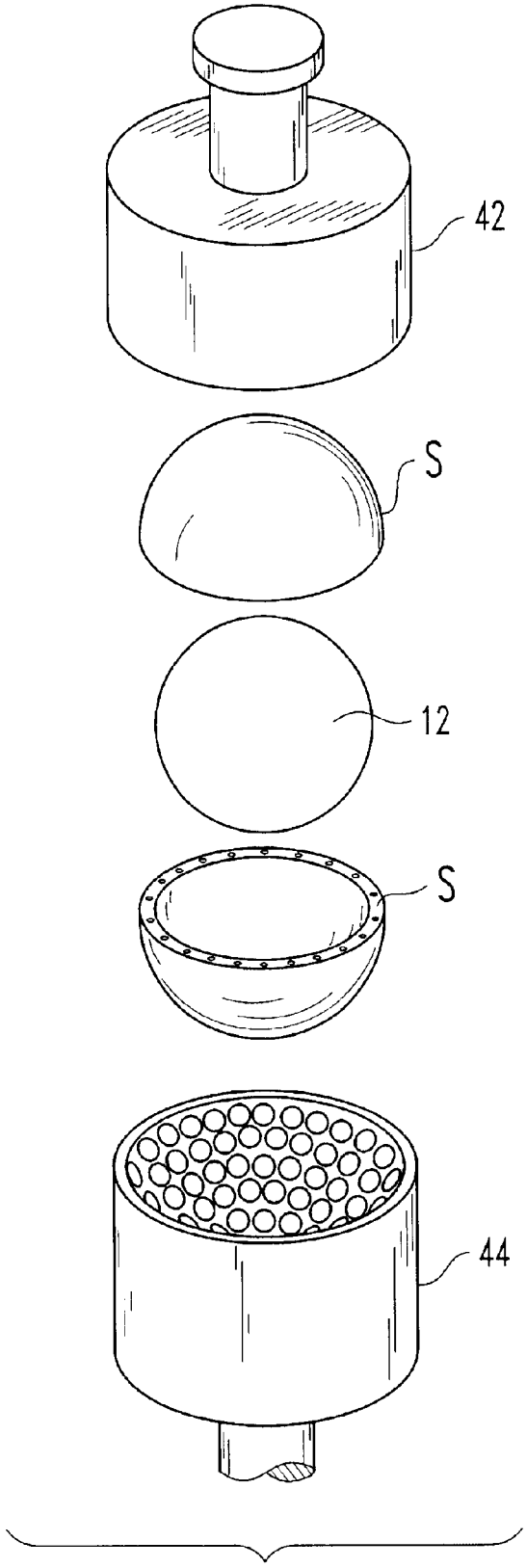
FIG. 7 is an exploded, perspective view of a compression mold for use in making golf balls in accordance to the present invention.

Hemispherical shells S can be cut from thin sheets 22 using a stamping method. Advantageously, the substantially parallel fibers 18 retain their orientation, when shells S are compression molded around core 12, as shown in FIG. 7, to form cover layer 14. Alternatively, shells S can be cut into figure-eight shapes, so long as two figure-eight shells can cover completely core 12, similar to the cover of a baseball or a tennis ball. A pair of shells S is positioned around core 12, and placed between a pair of compression mold-halves 42 and 44. Mold-halves 42 and 44 have a substantially hemispherical outer facing surface that includes protrusions for forming dimples 16 in cover 14. The mold-halves are advanced toward each other until their mating surfaces touch, and the mold-halves are heated to melt the shells S. Mold-halves 42 and 44 compress and heat the shells S about the core 12 to mold the cover material thereto and form the dimples 16 in cover 14.

Advantageously, ball 10 includes the fiber-reinforced cover 14, which comprises substantially parallel fibers 18 embedded therein. The length of fibers 18 may be as long as one-half of the circumference of ball 10. As stated above, the relatively long length of the reinforced fibers improves the flexural modulus and the impact resistance of the ball.

Figure 8:
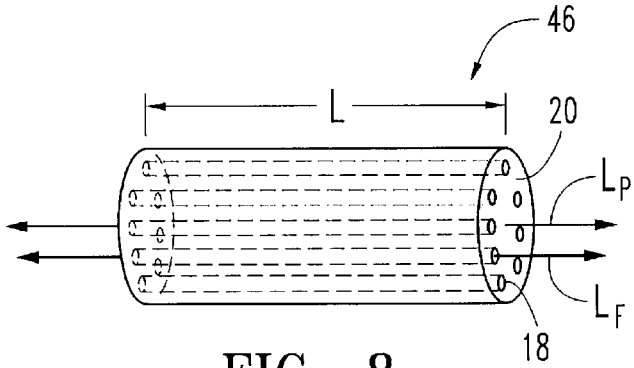
FIG. 8 is an enlarged perspective view of a pellet including non-randomly oriented fibers in a polymeric matrix for use in making golf balls in accordance to the present invention.

In accordance to another aspect of the present invention, cover 14 is made from pultruded thermoplastic fiber-reinforced pellets 46. Pellets 46 are formed by the pultrusion method similar to thin sheets 22. Pellets 46, as shown in FIG. 8, are formed as long rods or cylinders by heated die 32 and chopped by cutter 36, as shown in FIG. 6. As a result of pultrusion, fibers 18 are completely embedded in thermoplastic matrix material 20. Each fiber 18 has a fiber longitudinal axis $L_F$, and each pellet 46 has a longitudinal axis $L_P$. Fibers 18 are oriented with respect to one another in the matrix 320 such that the longitudinal axis $L_F$ of the fibers 318 are substantially parallel to one another and substantially parallel with the longitudinal axis $L_P$.

Pellets 46 are melted and then injection molded into hemispherical shells S, which are then compression molded around core 12, as discussed above and illustrated in FIG. 7, to form cover 14. The injection molding apparatus suitable for this embodiment is similar, albeit has fewer components, than the co-injection apparatus discussed below and illustrated in FIG. 9. Generally, a single component injection molding apparatus, which is known in the art, comprises a hopper to receive the pultruded fiber-reinforced pellets 46, a screw and a mold. The pultruded pellets 46 in the hopper are fed by gravity or other known means to the screw, where heat is added to melt the pellets. The screw then turns to pump a measured amount of the molten fiber-reinforced thermoplastics through a channel to the mold. The molten material is then cooled to form shells S. Shells S are then ejected from the mold to be compression molded on to core 12 to form cover 14.

Pellets 46 and embedded parallel fibers 18 are preferably about 1 mm to about 5 mm long, more preferably about 1 mm to about 3 mm long, and most preferably about 1.5 mm long. The length of fibers 18 may be reduced by the injection molding process, and may not retain the substantially parallel orientation to each other. On the other hand, due to their relatively longer lengths and parallel orientation in the hopper, the orientation of fibers 18 within cover 14 in this embodiment are less random than those of short fibers. Some fibers 18 may form open or closed loops and may also resemble a non-woven pattern.

Figure 9:
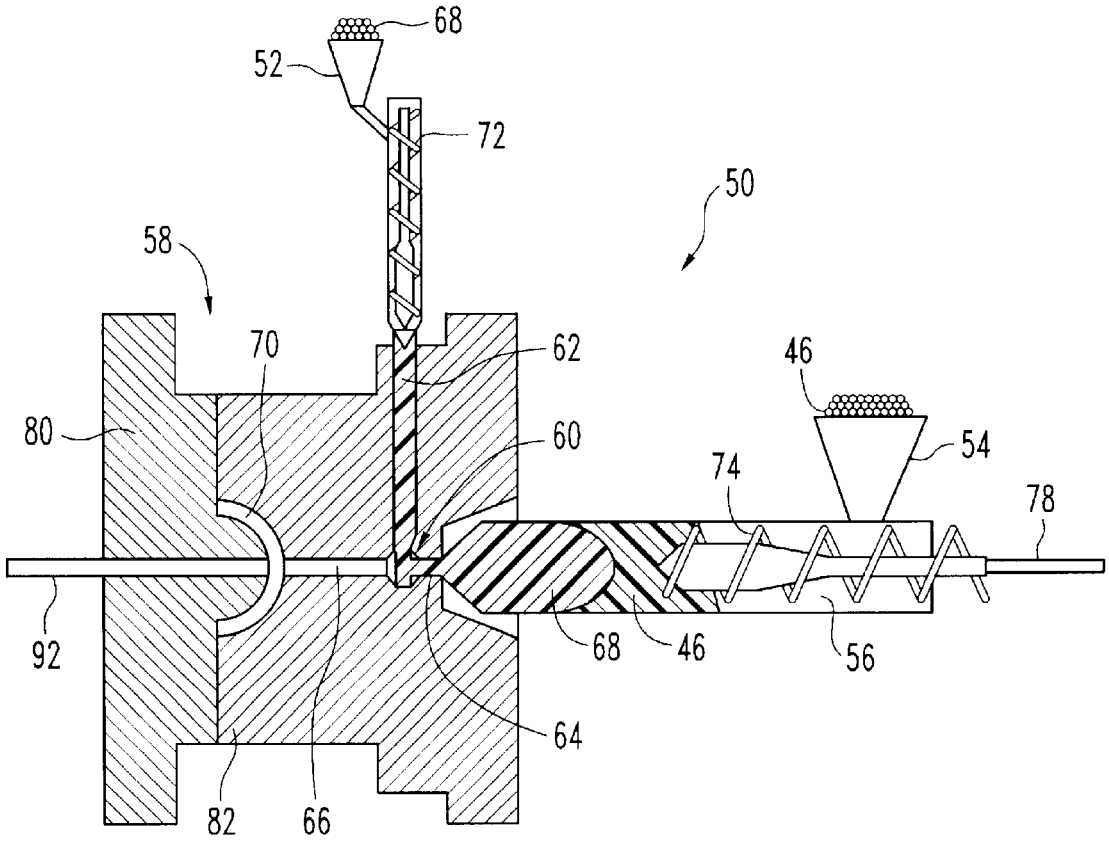
FIG. 9 is a schematic cross-sectional view of a co-injection molding apparatus for use in making golf balls in accordance to the present invention.
Figure 10:
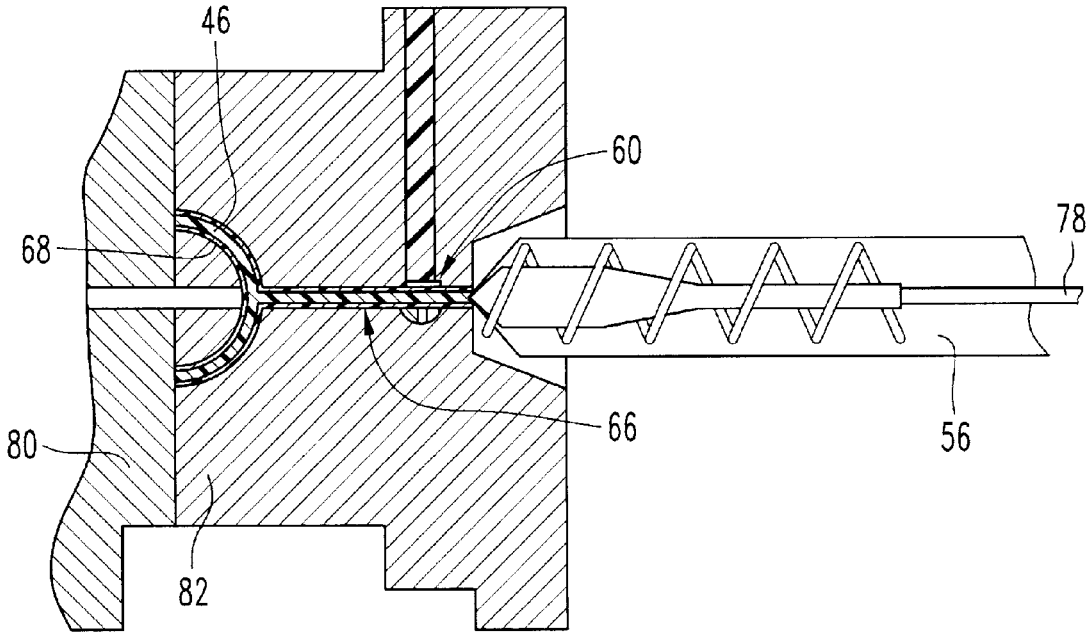
FIG. 10 is an enlarged cross-sectional view of a portion of the co-injection molding apparatus of FIG. 9.
Figure 11:
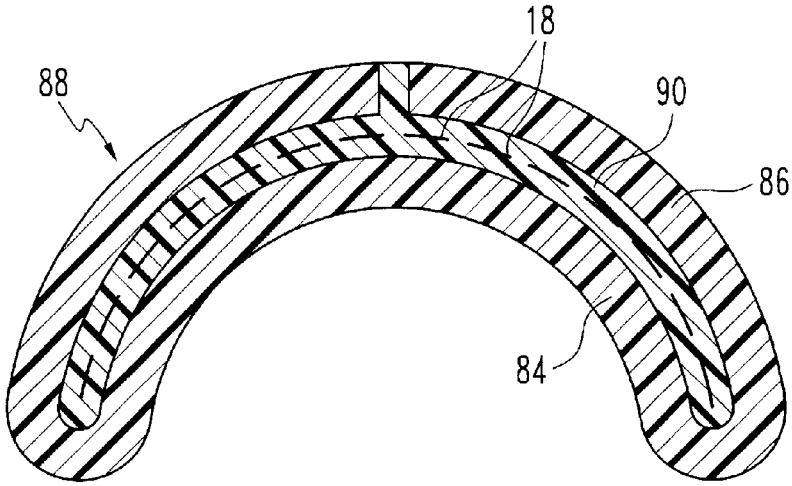
FIG. 11 is a cross-sectional view of a hemisphere formed using the mold of FIG. 9.

In accordance to another aspect of the present invention, pultruded pellets 46 can form a part of a multi-layer cover or a sandwich cover. Referring to FIGS. 9–11, a co-injection molding machine 50 is used to form multi-layer cover 14. The co-injection process to produce a sandwich cover is disclosed in commonly owned U.S. Pat. No. 5,783,293, which is incorporated herein by reference. The machine 50 produces co-injection or sandwich-injection molded two-material, golf ball hemispheres. The injection molding machine 50 includes two hoppers 52 and 54, an accumulation chamber 56, a mold 58, a three-way valve 60, and a plurality of channels 62, 64 and 66 interconnecting the same. More particularly, first hopper 52 contains a first material in the form of pellets 68 and second hopper 54 contains a second material in the form of fiber-reinforced pellets 46. In this embodiment, pellets 68 are not fiber-reinforced. The three-way valve 60 controls the flow direction of the materials 46 and 68. The first channel 62 connects the first hopper 52 with the three-way valve 60. The second channel 64 connects the accumulation chamber 56 to the three-way valve 60. The third channel 66 connects the three-way valve 60 with the mold cavity 70.

In a preferred process, pellets 68 of a first, conventional material are loaded into first hopper 52, where they are fed by gravity or other means known in the art to screw 72. Heat is applied to plasticize the first material 68 and screw 72 turns to pump a measured amount of plasticized first material pellets 68 through channel 62 to the three-way valve 60. The material is heated above its melt temperature. The three-way valve 60 is positioned such that the flow of the molten first material 68 is fed into the accumulation chamber 56. The accumulation chamber is heated such that the material 68 remains in the molten state. Valve 60 is a positionable valve for selectively permitting material flow from channel 62 into accumulation chamber 56; and material flow from accumulation chamber 56 to mold cavity 70 without diversion back into channel 62.

Pellets 46 including fibers 18 are loaded into second hopper 54, where they are feed by gravity or other means known in the art to screw 74. Heat is applied to the second material so that it is heated above its melt temperature and plasticized to form molten second, fiber-reinforced material 46. Screw 74 forces a measured amount of plasticized second material 46 into accumulation chamber 56, where the second material 46 and the first material 68 abut, as shown in FIG. 9.

With the three-way valve 60 in communication with mold cavity 70, a plunger 78 is used to force both the first material 68 and the second material 46 past three-way valve 60, through channel 66 and into the mold cavity 70 as shown in FIG. 10. The mold cavity 70 is substantially in the shape of a hemispherical half-shell, and is formed by a mold half 80 and a mold half 82. Plunger 78 is translated toward mold cavity 70, pushing materials 68 and 46 through valve 60 along channel 66 into mold cavity 70.

The first material 68 enters the mold cavity 70 first. The flow is circumferential about the cavity 70. The mold halves 80 and 82 are cooled so that the molten first material 68 solidifies along the walls of mold cavity 70. Preferably, the mold halves 80 and 82 are maintained at a temperature that allows the molten first material 68 to solidify to the mold walls forming inner and outer layers 84 and 86 of hemispherical shell 88. Since there is a temperature gradient in the first material 68, i.e., hot in the center and cold on the edges against the mold halves, the flow of molten material is much easier through the center. The material must be pushed into the mold cavity 70 with sufficient pressure to allow the material to fill the cavity before it solidifies. Preferably, the injection pressure is greater than about 2000 psi.

Second material 46 follows the first material 68 and flows through the center between the inner and outer layers 84 and 86, forming an intermediate layer 90 with fibers 18 embedded therein, as shown in FIG. 11. In order to increase the thickness of the inner and outer layers 84 and 86, more first material 68 can be used and the flow rate into the mold decreased. To make thinner inner and outer layers 84 and 86, less first material 68 is used and the flow rate into the mold increased. After the co-injection process, the reinforced fibers 18 in the intermediate layer 90 may no longer have the same orientation, as discussed above.

Once the materials 68 and 46 cool enough to substantially retain the shape of the mold cavity, the mold halves 80 and 82 are separated, and an ejector 92 ejects a two material, three-layer hemisphere 88 from the injection molding machine 50. After hemispherical shells 88 are formed they are used in a compression mold similar to that shown in FIG. 7 with core 12 to form cover 14. Alternatively, fiber-reinforced pellets 46 can be the first material and pellets 68 can be the second material, such that shells 88 have a center layer sandwiched between tow fiber-reinforced layers.

Preferably, the matrix material 20 is selected such that cover layer 14 has acceptable high flexural modulus for low driver spin and high impact resistance, but also provides an outer surface with sufficient friction to impart adequate spin on the ball for greenside performance. Advantageously, the relatively long reinforced fibers 18 increase the stiffness, as well as the impact resistance of cover layer 14. More specifically, adding fibers 18 to a thermoplastic polymer increases its flexural modulus, stiffness and its impact resistance, and makes the thermoplastic suitable for use in an outer layer of the golf ball. For example, polyethylene methacrylic acid resins or other non-ionomers, which have desirable properties such as low water vapor transmission rate and high melt flow index, can be improved by incorporating the relatively long reinforced fibers 18 therein to increase its flexural modulus and stiffness without compromising its impact resistance or unnecessarily increase spin. Another advantage is that such outer layers can be made very thin, preferably in the range of 0.010 inch to 0.030 inch, so that a very large core 12 can be employed. A large core is desirable, because it is the principal source of resilience and CoR of the golf ball.

Another advantage of incorporating the relatively long reinforced fibers 18 into an outer layer is that lesser-used materials can now be employed. For example, relatively high flexural modulus materials with relatively low impact resistance, such as polycarbonates and acrylonitrile butadiene styrene (ABS), can have fibers 18 incorporated therein to improve the impact resistance. Such materials are now more suitable for use as an outer layer, such as an inner or outer cover layer or an outer core layer.

Preferred thermoplastic matrix material 20 include those that have low flexural modulus, in the range of about 500 psi and about 30,000 psi, relatively low resilience and high spin, and those that have high flexural modulus, in the range of greater than about 70,000 psi and more preferably in the range of greater than about 80,000 psi, and low impact resistance. As stated above, these matrix materials are improved by reinforcement with the relatively long fibers 18, in accordance to the invention.

Suitable low flexural modulus, relatively low resilience and high spin thermoplastics include, but are not limited to, thermoplastic urethanes and polyethylene methacrylic acid resins commercially available as Nucrel® from DuPont. Additional suitable thermoplastics include copolymers of ethylene and methacrylic acid having an acid level from about 3% to about 25% by weight. More preferably, from about 4% to about 15%, and most preferably from about 7% to about 11%. Copolymers of ethylene and methacrylic acid have an advantage in that these compounds typically have high melt flow index. Other suitable thermoplastics include copolymers of polyethylene and a carboxylic acid, or terpolymers of ethylene, a softening acrylate class ester such as methyl acrylate, n-butyl-acrylate or iso-butyl-acrylate, and a carboxylic acid. Exemplary carboxylic acids are acrylic acid or methacrylic acid. Exemplary softening acrylate class esters are methyl acrylate, n-butyl-acrylate or iso-butyl-acrylate. Examples of such terpolymers include polyethylene-methacrylic acid-n or iso-butyl acrylate and polyethylene-acrylic acid-methyl acrylate, polyethylene ethyl or methyl acrylate, polyethylene vinyl acetate, polyethylene glycidyl alkyl acrylates. Other suitable low flexural modulus thermoplastics include "very low modulus acid copolymer ionomer" or VLMI, wherein the copolymer contains about 10% by weight of acid and 10–90% of the acid is neutralized by sodium, zinc or lithium ions. The VLMI has flexural modulus of about 2,000 to 8,000 psi. Suitable VLMIs include Surlyn® 8320 (Na), Surlyn® 9320(Zn) and Surlyn® 8120(Na). These high acid copolymer ionomers and VLMIs are described in U.S. Pat. No. 6,197,884.

A benefit of using these thermoplastics is that a very thin layer with low water vapor transmission rate can be obtained. The benefits of higher melt flow index include easier extrusion, higher extrusion rate, higher flow during heat sealing, and the ability to make thin cover layers or thin films. Without limiting the present invention to any particular theory, materials with relatively high melt flow index have relatively low viscosity. Low viscosity helps the materials spread evenly and thinly to produce a thin film.

Suitable high flexural modulus and low impact resistance thermoplastics include polycarbonates, acrylonitrile butadiene styrene (ABS), which has flexural modulus in the range of about 300,000 psi, and high acid content Surlyn® ionomers, among others.

Additionally, other suitable thermoplastics include polyethylene, polystyrene, polypropylene, thermoplastic polyesters, acetal, polyamides including semicrystalline polyamide, polycarbonate (PC), shape memory polymers, polyvinyl chloride (PVC), trans-polybutadiene, liquid crystalline polymers, polyether ketone (PEEK), bio(maleimide), and polysulfone resins. Other preferred thermoplastics for forming the matrix 20 include other Surlyn® from DuPont and, single-site catalyzed polymers including non-metallocene and metallocene, polyurethane, polyurea, or a combination of the foregoing. Suitable polymeric materials also include those listed in U.S. Pat. Nos. 6,187,864, 6,232,400, 6,245,862, 6,290,611 and 6,142,887 and in PCT publication no. WO 01/29129, which are incorporated herein by reference in their entirety. Suitable materials are also disclosed in a patent application entitled "Golf Ball With Vapor Barrier Layer," bearing application Ser. No. 10/077,081, filed on Feb. 15, 2002. The disclosures of this application are incorporated by reference herein in its entirety.

The matrix 20 can also be formed of at least one ionomer, ionomer blends, non-ionomers or non-ionomer blends. For example, the matrix 20 can include highly neutralized polymers as disclosed in WO 01/29129 incorporated by reference herein in its entirety. The matrix 20 can also be formed of combinations of the above-described matrix materials, including terpolymers of ethylene, methyl acrylate and acrylic acid (EMAAA), commercially available under the tradename Escor® Acid Terpolymers from Exxon Mobile Chemical.

The specific formulations of these matrix materials may include additives, other fillers, inhibitors, catalysts and accelerators, and cure systems depending on the desired performance characteristics. The matrix material can be at least one polymer or a blend of polymers. One such recommended material for the matrix is Nylon.

The fibers and/or the matrix can be optionally surface treated with a suitable coupling agent, bonding agent or binder. This coupling agent improves the adhesion between the fibers and the polymeric matrix and reduces the number of voids present in the matrix material. A void is an undesirable air pocket in the matrix that does not support the fibers. Unsupported fibers under a load may buckle and transfer the stresses to the matrix, which could crack the matrix. The coupling agents can be functional monomers, oligomers and polymers. The functional groups include, but are not limited to, maleic anhydride, maleimide, epoxy, hydroxy amine, silane, titanates, zirconates, and aluminates.

As stated above, the long fiber-reinforced layer can be cover layer 14, as illustrated in FIG. 1, or one or more layer in the golf ball. For example, as illustrated in FIG. 2, golf ball 10 includes core 12 and an intermediate layer 94 disposed thereon, and a cover 96. The intermediate layer 94 includes a plurality of fibers 18 embedded in matrix material 20, as described with respect to cover layer 14. Preferably, the intermediate layer 94 is made either by compression molding two shells S cut from pultruded thin sheets 22 around core 12, or by compression molding two shells formed by injection molding pultruded pellets 46, discussed in details above. Hence, fibers 18 may be arranged in a random or non-random pattern in intermediate layer 94. Cover layer 96 can be formed from conventional cover compositions using techniques known by those of ordinary skill in the art, and in this embodiment contains no reinforced fibers. Cover layer 96 may be formed of conventional cover layer materials such as balata, at least one ionomer, ionomer blends, non-ionomers or non-ionomer blends. For example, the cover can include highly neutralized polymers disclosed in WO 01/29129. Cover layer 96 can also be formed of single-site catalyzed polymers including non-metallocene and metallocene catalyzed polyurethane, polyurea, or a combination of the foregoing.

In the embodiment shown in FIG. 3, golf ball 10 has core 12 and fiber-reinforced intermediate layer 94 disposed thereon and fiber-reinforced cover 14. In the embodiment shown in FIG. 4, golf ball 10 has core 12 and a multi-layer sandwich cover. As discussed above, the sandwich cover is made by compression molding two hemispherical sandwich shells 88 together. The cover comprises inner and outer cover layers 84 and 86, which are formed of a first material, and the intermediate cover layer 90, which is formed of a second material different from the first material. The first material preferably is a thermoplastic such as those disclosed above to form matrix material 20. Most preferably, the first material is a copolymer of ethylene and methacrylic acid having an acid level from about 3% to about 25% by weight, such as Nucrel®, due to the high melt flow index, which can produce a thin layer. The intermediate cover layer 90 includes a plurality of fibers 18 embedded in matrix material 20. The matrix material for layer 90 can be the same as the matrix material for layers 84 and 86.

In other embodiments, golf ball 10 may comprise a sandwich intermediate layer encasing the core, with the middle layer being reinforced by fibers 18, and a sandwich cover layer, with the middle cover layer being reinforced by fibers 18. Alternatively, golf ball may comprise a sandwich intermediate layer encasing the core, with the middle layer being reinforced by fibers 18, and a conventional single-layer or dual-layer cover layer. Features described with respect to any embodiment can be used singly or in combination with other features in the same or different embodiments, and be within the scope of the present invention.

While the above invention has been described with reference to certain preferred embodiments, it should be kept in mind that the scope of the present invention is not limited to these embodiments. For example, various other commercially available co-injection molders can be used such as those that can be retro-fit to existing injection molding apparatus or those with hot runner systems. A hot runner system can provide two materials into a cavity from the same gate rather than from separate gates as shown in FIG. 9. One skilled in the art may find variations of these preferred embodiments, which, nevertheless, fall within the spirit of the present invention, whose scope is defined by the claims set forth below.

What is claimed is:

1. A golf ball comprising:

a core, and at least one layer encasing the core, wherein at least a portion of the encasing layer is made from a pultruded polymer and wherein said pultruded polymer comprises a plurality of discrete fibers orientated in a predetermined pattern and embedded in a polymeric matrix, the predetermined pattern comprising the discrete fibers arranged substantially parallel to each other.

2. The golf ball of claim 1, wherein said portion of the encasing layer is made by compression molding shells formed by injection molding the pultruded polymer.

3. The golf ball of claim 2, wherein the orientation of the fibers in said portion of the encasing layer is different than the predetermined pattern.

4. The golf ball of claim 2, wherein the pultruded polymer comprises pultruded pellets.

5. The golf ball of claim 2, wherein the encasing layer is a sandwich layer comprising an inner layer, an outer layer and an intermediate layer, wherein the intermediate layer is made from pultruded polymer.

6. The golf ball of claim 5, wherein the sandwich layer is made by co-injection molding.

7. The golf ball of claim 2, wherein the fibers are at least about 1 mm long.

8. The golf ball of claim 7, wherein the fibers are about 1 mm to about 5 mm long.

9. The golf ball of claim 8, wherein the fibers are about 1 mm to about 3 mm long.

10. The golf ball of claim 9, wherein the fibers are about 1.5 mm long.

11. The golf ball of claim 1, wherein said portion of the encasing layer is made by compression molding shells cut from a sheet of the pultruded polymer.

12. The golf ball of claim 11, wherein the fibers are at least about 1 mm long.

13. The golf ball of claim 12, wherein the fibers are about 1 mm long to about one-half of the circumference of the encasing layer.

14. The golf ball of claim 1, wherein the encasing layer is a cover layer.

15. The golf ball of claim 1, wherein the encasing layer is an intermediate layer, which is encased by a cover layer.

16. The golf ball of claim 1, wherein the fibers are selected from a group consisting of aramid fibers, glass fibers, carbon fibers, metallic fibers, ceramic fibers, cotton fibers, flax, jute, hemp and silk.

17. The golf ball of claim 1, wherein the polymeric matrix comprises a thermoplastic polymer.

18. The golf ball of claim 17, wherein the thermoplastic polymer has a flexural modulus between about 500 psi to about 30,000 psi.

19. The golf ball of claim 17, wherein the thermoplastic polymer has a flexural modulus greater than about 70,000 psi.

20. The golf ball of claim 19, wherein the flexural modulus is greater than about 80,000 psi.

21. A golf ball comprising a core and at least one layer encasing the core, wherein at least a portion of the encasing layer is reinforced by a plurality of discrete fibers arranged substantially parallel to each other in a predetermined pattern embedded in a polymeric matrix.

22. The golf ball of claim 21, wherein the fibers are at least about 1 mm long.

23. The golf ball of claim 22, wherein the fibers are about 1 mm long to about one-half of the circumference of the encasing layer.

24. The golf ball of claim 21, wherein the fibers are selected from a group consisting of aramid fibers, glass fibers, carbon fibers, metallic fibers, ceramic fibers, cotton fibers, flax, jute, hemp and silk.

25. A method of a golf ball comprising the steps of:

providing a core;

providing a pultruded polymer comprising the discrete fibers arranged substantially parallel to each other;

embedded the pultruded polymer in a polymeric matrix; and forming at least one layer about the core with the polymer matrix.

* * * * *